United States Patent [19]

Newham

[11] Patent Number: 4,673,947

[45] Date of Patent: Jun. 16, 1987

[54] CASSEGRAIN AERIAL SYSTEM

[75] Inventor: Paul Newham, Middlesex, England

[73] Assignee: The Marconi Company Limited, England

[21] Appl. No.: 834,250

[22] PCT Filed: Jun. 28, 1985

[86] PCT No.: PCT/GB85/00290

§ 371 Date: Feb. 20, 1986

§ 102(e) Date: Feb. 20, 1986

[87] PCT Pub. No.: WO86/00761

PCT Pub. Date: Jan. 30, 1986

[30] Foreign Application Priority Data

Jul. 2, 1984 [GB] United Kingdom ..... 8416823

[51] Int. Cl.[4] ..... H01Q 19/19

[52] U.S. Cl. ..... 343/781 CA; 343/785

[58] Field of Search ..... 343/785, 781 P, 781 CA, 343/840

[56] References Cited

U.S. PATENT DOCUMENTS 4,188,632 2/1980 Knox ..... 343/781 P 4,498,061 2/1985 Morz et al. ..... 343/781 CA

*Primary Examiner*—Eli Lieberman

*Attorney, Agent, or Firm*—Kirschstein, Kirschstein, Ottinger & Israel

[57] ABSTRACT

A high bandwidth microwave antenna feed comprises a spigot (4) of relatively high dielectric constant protruding from a conventional hollow waveguide (3) and a generally conical member (12) of relatively low dielectric constant fitted coaxially onto, so as to expand from the protruding spigot. The base portion (2) of the conical member is silvered and constitutes a sub-reflector. In use, microwave radiation from the hollow waveguide is refracted at the spigot/conical member interface and is reflected from the sub-reflector to a facing main reflector (1). The two-part dielectric construction enables the dimensions of the sub-reflector to be reduced, thereby reducing blockage of the main reflector and increasing the bandwidth of the system.

8 Claims, 1 Drawing Figure

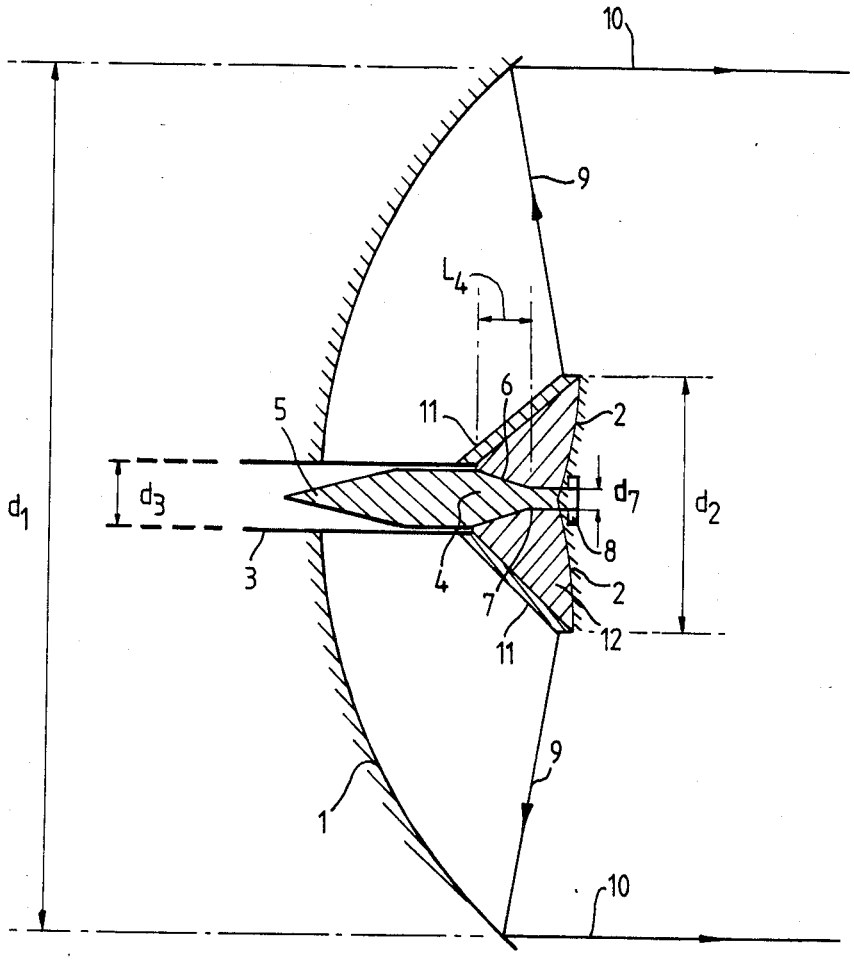
10
9
L4
6
5
11
2
d1
d3
d7
d2
8
3
4
7
2
11
12
9
1
10

CASSEGRAIN AERIAL SYSTEM

BACKGROUND OF THE INVENTION

1. Field of the Invention

The present invention relates to Cassegrain aerial systems, that is to say aerial systems of the type comprising a relatively large main reflector facing a relatively small sub-reflector. The invention relates particularly to small Cassegrain aerial systems in which the maximum dimension of the main reflector is comparable to the wavelength of the radiation employed—of the order of ten wavelengths or less for example.

2. Description of Related Art

A problem which arises in all Cassegrain aerial systems, and which becomes particularly acute when the mainreflector is less than ten wavelengths in diameter, is interference between the sub-reflector and the main reflector beam, in both reception and transmission. This can be reduced by reducing the size of the sub-reflector, but if the sub-reflector is too small, then radiation which would otherwise have been reflected from the sub-reflector spills over around its edges and interferes with the main reflector beam, resulting in high side lobes and a consequent loss of directivity. It will be appreciated that "spillover" is liable to arise in both reception and transmission. Interference and spillover, being wavelength-dependent, tend to severely limit the bandwidth of the aerial system.

Considering the case of transmission only, for the sake of simplicity, a satisfactory performance can only be achieved by utilising a small sub-reflector fed by a correspondingly narrow beam of radiation (which has a frequency typically of the order of several GHz). A conventional feed-horn is not suitable for generating this narrow radiation beam because it would need to be of comparable diameter to the sub-reflector and would therefore be liable to cause interference. Instead a dielectric aerial (or "polyrod") has been used, which consists of a rod of polythene or other suitable dielectric material extending from a conventional tubular waveguide towards the sub-reflector. The polyrod acts as a leaky waveguide, so that its radiation pattern is determined essentially by the length of the portion which extends from the tubular waveguide, and depends only weakly on its diameter, in accordance with a formula given on page 37 of the book "Dielectric Aerial" by D. C. Kiely (published by Methuen & Co.). This book is hereby incorporated by reference.

A narrow beamwidth can thus be obtained from a small-diameter polyrod. However, the sub-reflector must be maintained in accurate alignment with the polyrod in order to achieve a satisfactory performance. In order to maintain accurate alignment of the polyrod and sub-reflector, particularly under conditions of high acceleration, fairly substantial supporting struts are required. However the struts tend to interfere with the radiation beam emerging from the sub-reflector.

In response to this essentially mechanical problem, the splashplate was developed. This consists of a spigot expanding into a generally conical portion, on the base of which conical portion a metal film is deposited to form the sub-reflector. Thus the sub-reflector is supported entirely by its dielectric feed, and, since it is integral with its dielectric feed, no misalignment can arise. The aerial performance achieved represents the current state of the art.

SUMMARY OF THE INVENTION

We have found that a substantial further improvement in performance, in terms of increased bandwidth and/or directivity, can be achieved by a simple modification to the construction of the splashplate. Alternatively the invention may be considered to arise from a modification of the polyrod.

According to the present invention a Cassegrain aerial system comprises a main reflector facing a sub-reflector, and a dielectric feed directed towards the sub-reflector, said dielectric feed comprising an elongate inner dielectric member fitted within a substantially coaxial elongate outer dielectric member, the dielectric constant of the inner dielectric member being greater than that of the outer dielectric member and said dielectric members and sub-reflector being so arranged that in use, a narrow radiation beam propagates between the sub-reflector and the inner dielectric member through the outer dielectric member.

The aerial system may be adapted for reception or transmission or both, and may be incorporated in a radar system.

The wavelength of the radiation beam may be between 10% and nearly 50% of the maximum dimension of the sub-reflector.

Preferably the sub-reflector comprises a metallic film deposited on the outer dielectric member. However in some cases the sub-reflector may be a discrete metal plate. The outer dielectric member is preferably of generally conical form, with a metallic film constituting the sub-reflector deposited on its base and the inner dielectric member inserted into a hole in its apex.

The inner dielectric member may be tapered and fitted into a correspondingly countersunk hole in the outer dielectric member in order to reduce the impedance mismatch between them. The inner and outer dielectric members may be mechanically held in mutual engagement, by screw means for example. Thus the inner dielectric member may extend through the outer dielectric member to protrude in a threaded portion, a nut being screwed onto the protruding portion of the inner dielectric member to engage the outer dielectric member and force the tapered and countersunk portions of the respective members together. In some cases both the dielectric members may be threaded and screwed together.

BRIEF DESCRIPTION OF THE DRAWINGS

One embodiment of the invention will now be described by way of example with reference to the accompanying drawing, which is a diagrammatic axial section, drawn approximately to scale, showing an X-band Cassegrain radar aerial arrangement.

The arrangement comprises a main reflector 1, a sub-reflector in the form of a silvered surface 2 which directs a narrow beam 9 of microwave radiation onto the main reflector, a tubular metal waveguide 3 of circular cross-section which feeds microwave radiation to an inner dielectric member 4, and a generally conical outer dielectric member 12 which transmits a microwave radiation from inner member 4 to silvered surface 2. Main reflector 1 can be steered independently of the sub-reflector (by means not shown) and generates a narrow collimated beam 10. The radar aerial system shown may be used in both reception and transmission, but its operation is here described in relation to the transmission only, for the sake of simplicity.

Both the inner and outer dielectric members 4 and 12 are circularly symmetric about their common axis. Inner dielectric member 4 is constructed of "STYCAST HI-K" plastics material of dielectric constant 4.0, as supplied by Emerson and Cuming Ltd., of Scunthorpe, South Humberside, U.K. Outer dielectric member 2 is constructed of polyethylene, of dielectric constant 2.25. As an alternative construction, the inner dielectric member may be "STYCAST-0005" plastic material of dielectric constant 2.53, supplied by Emerson and Cuming Ltd. The outer dielectric member is then constructed from a low dielectric constant foam such as P10 supplied by Plessey Materials of Towcester, Northants, of dielectric constant 1.07. Consequently the tapered portion 6 of inner dielectric member 4 acts as a leaky waveguide, and radiates a circularly symmetric field in the HE11 mode into the outer dielectric member, in essentially the same way as a polyrod of dielectric constant 1.77 (=4.0/2.25) radiating into free space. The HE11 mode is a highly efficient mode for feeding a reflector antenna, since it radiates a circularly symmetric field with low cross polar content. The portion 6 is tapered in order to minimise the VSWR at the interface between the dielectric members. A similar tapered portion 5 is provided to match the impedances of tubular waveguide 3 and dielectric member 4. A reduced portion 7 of dielectric member 4 extends through the outer dielectric member 12 and its protruding end is threaded and carries a nut 8 which holds the two dielectric members together. The reduced portion 7 has a sufficiently small diameter in relation to the wavelength of the microwave radiation used to ensure that it has little or no radiating effect.

The effective aperture of dielectric member 4 is determined essentially by the length $L_4$ of its tapered portion 6, which is appreciable. Therefore the reflecting surface 2 is in the near field and the field distribution at this surface is best determined with the aid of experimental measurements of field strength in a simplified system, such as a simple tubular outer dielectric member in which a rod-shaped member is inserted, for example.

The relevant design techniques are similar to those employed in the design of conventional splashplate feeds, and the following publications are accordingly incorporated by reference:

(a) U.K. Pat. No. 1,531,242

(b) I.E.E. publication No. 195 (I.C.A.P.) p. 354 "A high efficiency splashplate feed"—P. Newham.

(c) I.E.E. publication No. 219 p. 348 "The search for an efficient splashplate feed"—P. Newham.

The profile of the curved silvered surface 2 can suitably be determined by geometric optics or diffraction optimisation techniques, in order to maximise the illumination of the main reflector 1.

A thin layer 11 of syntactic foam (of dielectric constant approximately 1.5) reduces internal reflection of the radiation beam reflected through the conical surface of the outer dielectric member 12. In some cases it may be advantageous to make this surface curved (for example, spherical) rather than conical, in order to appropriately refract the radiation directed from sub-reflector 2 onto main reflector 1. In cases where the inner and outer dielectric members are composed of low dielectric constant materials (such as the "STYCAST-0005"/P10 foam combination referred to hereinabove) layer 11 may be dispensed with.

Although the portion of the dielectric member 4 which projects into the outer dielectric member 12 is shown tapered at the inner end, it is not absolutely necessary that this be so and the taper may extend over any part of this projecting portion.

The diameters $d_1$, $d_2$, $d_3$, $d_7$ and length $L_4$ shown in the drawing are as follows:

$d_1$—350 mm $d_2$—110 mm $d_3$—26 mm $d_7$—9 mm $L_4$—25 mm

Measurements obtained using these dimensions in conjunction with a 350 mm diameter parabolic dish show an antenna efficiency exceeding 50% over a 16% bandwidth and exceeding 60% over a 10% band. This should be compared with measurements taken with a conventional splashplate of the same diameter where antenna efficiency drops to below 10% over the same 10% band owing to the destructive interference between forward spillover and the main aperture field.

The centre frequency was 8 GHz, corresponding to a wavelength of approximately 25 mm in the dielectric material Clearly the arrangement offers a high efficiency for such a small antenna, essentially due to the narrow radiation beam fed to reflector 2. This narrow beam can be considered to arise from refraction of the microwave radiation at the interface between the inner and outer dielectic members. However this is only a crude explanation, since the dimensions of the components are comparable to the wavelength. Thus the significantly increased performance offered by the design is not easily accounted for.

A slight further improvement in performance can be achieved by providing an annular groove in surface 2 around the nut 8, in order to reduce internal reflections.

I claim:

1. A Cassegrain aerial system, comprising:

(a) a main reflector; and (b) a dielectric feed projecting through said main reflector and including (i) an elongate inner dielectric member having an end and a dielectric constant, (ii) a coaxial outer dielectric member closely surrounding said end of said inner dielectric member about an axis and having a dielectric constant, said outer dielectric member diverging away from said main reflector, and having an end face remote from said main reflector, (iii) a metallic film deposited on said end face and providing a sub-reflector which faces said main reflector, (iv) said metallic film being supported solely by said outer dielectric member, and (v) said dielectric constant of said inner dielectric member being greater than said dielectric constant of said outer dielectric member so that said dielectric feed has an effective dielectric constant which decreases continuously from said axis outwards and constrains radiation from said dielectric feed to a narrow beam intercepting said sub-reflector with negligible spillover.

2. The Cassegrain aerial system as claimed in claim 1, wherein said outer dielectric member is of generally conical form.

3. The Cassegrain aerial system as claimed in claim 2, wherein said inner dielectric member and said outer dielectric member are held in mutual engagement by screw means.

4. The Cassegrain aerial system as claimed in claim 3, wherein said inner dielectric member has an impedance-matching tapered portion which extends through said outer dielectric member, and protrudes therefrom in a threaded portion, and further comprising a nut being screwed onto the threaded portion to hold said tapered portion in engagement with a correspondingly countersunk portion in said outer dielectric member.

5. The Cassegrain aerial system as claimed in claim 2, wherein a layer of dielectric material of substantially lower dielectric constant than said dielectric constant of said outer dielectric member is provided on an outer surface thereof.

6. The Cassegrain aerial system as claimed in claim 1, wherein said inner dielectric member extends within, and is supported by, a tubular metallic waveguide which extends between said main reflector and said outer dielectric member.

7. A radar system incorporating a Cassegrain aerial system as claimed in claim 1, wherein the wavelength of said narrow radiation beam is between 10% and 40% of the maximum dimension of the sub-reflector.

8. The radar system as claimed in claim 7, wherein, in use, said inner dielectric member radiates a circularly symmetric field in the HE11 mode into said outer dielectric member.

* * * * *